US010088230B2

(12) United States Patent
Cookson et al.

(10) Patent No.: US 10,088,230 B2
(45) Date of Patent: Oct. 2, 2018

(54) DRYER FOR PORTABLE ELECTRONICS

(71) Applicant: TekDry, LLC, Broomfield, CO (US)

(72) Inventors: Adam Roy Cookson, Broomfield, CO (US); Eric Andrew Jones, Westminster, CO (US)

(73) Assignee: TEKDRY INTERNATIONAL, INC., Westminster, CO (US)

( * ) Notice: Subject to any disclaimer, the term of this patent is extended or adjusted under 35 U.S.C. 154(b) by 864 days.

(21) Appl. No.: 14/179,313

(22) Filed: Feb. 12, 2014

(65) Prior Publication Data

US 2014/0157619 A1 Jun. 12, 2014

Related U.S. Application Data

(63) Continuation-in-part of application No. 13/869,812, filed on Apr. 24, 2013, now Pat. No. 8,689,461.

(60) Provisional application No. 61/724,129, filed on Nov. 8, 2012.

(51) Int. Cl.

| | |
|---|---|
| ***F26B 5/04*** | (2006.01) |
| ***H05B 3/42*** | (2006.01) |
| ***F26B 5/16*** | (2006.01) |

(52) U.S. Cl.

CPC ..... *F26B 5/04* (2013.01); *F26B 5/16* (2013.01); *H05B 3/42* (2013.01)

(58) Field of Classification Search

CPC ..... H01L 21/67109; H01L 21/67034; F26B 9/003; F26B 21/06; F26B 5/04; F26B 5/16; C09K 5/14

USPC ..... 206/204; 34/412

See application file for complete search history.

(56) References Cited

U.S. PATENT DOCUMENTS

| | | | |
|---|---|---|---|
| 3,698,098 | A | 10/1972 | Ramsay |
| 4,054,376 | A | 10/1977 | Wareham |
| 5,038,494 | A | 8/1991 | Lundquist et al. |
| 5,222,307 | A | 6/1993 | Oba et al. |

(Continued)

FOREIGN PATENT DOCUMENTS

| | | |
|---|---|---|
| AU | 2003100364 | 7/2003 |
| CA | 2050668 A1 | 3/1992 |

(Continued)

OTHER PUBLICATIONS

Andrew, "Saving a wet cell phone with dry rice . . . Holy crap, it actually works!", Apr. 21, 2011, http://openattitude.com/2011/04/12/saving-a-wet-cell-phone-with-dry-rice-holy-crap-it-actually-works/.*

(Continued)

*Primary Examiner* — Jason Lau

(74) *Attorney, Agent, or Firm* — Marsh Fischmann & Breyfogle LLP; Russell T. Manning; Daniel J. Sherwinter

(57) ABSTRACT

Systems and methods are described for conductively heated vacuum-based drying of portable electronic devices. For example, a portable electronic device that has been exposed to excessive liquid is placed inside a drying chamber. The drying chamber is closed and a drying routine commences. During the drying routine, the chamber is pressurized to a vacuum level sufficient to gasify liquids inside the device, and the device is conductively heated at least to replace latent heat of vaporization lost during the pressurization. Some embodiments include techniques relating to payment processing, monitoring and feedback control, decontamination, and/or other functionality.

32 Claims, 7 Drawing Sheets

(56) References Cited

U.S. PATENT DOCUMENTS 5,376,392 A * 12/1994 Ikegami ..... B32B 5/18 206/204
5,377,425 A * 1/1995 Kawakami ..... H05K 3/227 34/408
5,636,446 A * 6/1997 Mae ..... F26B 9/066 34/195
6,170,171 B1 1/2001 Schmidbauer et al.
6,530,160 B1 3/2003 Gookins
6,893,530 B2 5/2005 Kishimoto et al.
7,418,970 B2 9/2008 Sugimoto et al.
2003/0115768 A1* 6/2003 Hoffman ..... D06F 58/24 34/92
2005/0044744 A1* 3/2005 Tadano ..... D06F 58/206 34/596
2005/0081890 A1 4/2005 Ato et al.
2005/0217136 A1* 10/2005 Blankenship ..... F26B 5/045 34/406
2006/0137213 A1* 6/2006 Asuke ..... F26B 11/18 34/402
2006/0277782 A1* 12/2006 Chen ..... F26B 3/286 34/92
2007/0199203 A1 8/2007 Federico
2008/0063809 A1* 3/2008 Lee ..... H01L 21/3105 427/558
2008/0256822 A1* 10/2008 Suzuki ..... A23L 3/44 34/92
2009/0022434 A1* 1/2009 Chiba ..... B01D 53/261 383/109
2009/0077825 A1* 3/2009 Toofan ..... H01L 21/67034 34/273
2009/0090022 A1* 4/2009 Ho ..... F26B 3/28 34/406
2009/0145783 A1* 6/2009 Forker ..... B65D 81/266 206/204
2010/0088922 A1* 4/2010 Romanek ..... F26B 9/003 34/275
2010/0122470 A1* 5/2010 Davis ..... F26B 21/083 34/472
2011/0047814 A1* 3/2011 Watson ..... F26B 9/066 34/507
2011/0060945 A1* 3/2011 Leprince ..... G06F 11/0748 714/25
2011/0219640 A1* 9/2011 Latos ..... F26B 23/02 34/487
2011/0247233 A1* 10/2011 Bland ..... C10B 57/10 34/333
2012/0079100 A1* 3/2012 McIntyre ..... G06F 11/0742 709/224
2015/0122422 A1* 5/2015 Hayasaka ..... H01J 37/32467 156/345.53
2015/0226481 A1 8/2015 Marchiori

FOREIGN PATENT DOCUMENTS

| | | |
|---|---|---|
| EP | 1080333 | 8/2009 |
| JP | 2003142451 | 5/2003 |
| JP | 2006324506 | 11/2006 |
| JP | 3139842 | 3/2008 |
| WO | 2006028572 | 3/2006 |

OTHER PUBLICATIONS

Frugal Fix: Revive your Cell Phone or Electronic Devices from Water Damage; http://www.fiscalgeek.com/2009/06/ff_water_damaged_cellphone/: Jun. 2009; 10 pages.
International Search Report and Written Opinion, dated Feb. 25, 2014, 11 pages.
Canadian Office Action, dated Jan. 4, 2017, for Application 2,927,450.
Supplementary European Search Report dated Jul. 7, 2016, 7 pages.

* cited by examiner

DRYER FOR PORTABLE ELECTRONICS

FIELD

Embodiments relate generally to drying systems, and, more particularly, to vacuum-based drying systems for portable electronic devices.

BACKGROUND

Portable electronic devices are becoming ubiquitous, and increasing numbers of individuals rely on those devices for access to business communications, personal communications, and entertainment. While the devices are typically designed to withstand certain levels of shock, exposure to heat and cold, and other undesirable conditions, most still become non-functional when overexposed to water. For example, it is not uncommon for people to spill excessive liquid on their cell phones or to drop their cell phones into toilets, swimming pools, and sinks. Many remedies have been proposed for resuscitating portable electronic devices after over-exposure to liquid. Some proposed remedies involve exposing the devices to anything from alcohol or salt water to rice or other desiccants. Other proposed remedies involve disassembling the device to allow internal electronic components maximum exposure to the air. Many of these proposed remedies are ineffective, for example, removing too little liquid from the device and/or removing liquid too slowly. Some of these proposed remedies even cause further damage (and can often void warranties and/or protection plans on the devices).

BRIEF SUMMARY

Among other things, systems and methods are described for conductively heated, vacuum-based drying of portable electronic devices. In one embodiment, a portable electronic device (e.g., a smart phone) that has been exposed to excessive liquid is placed inside a drying chamber. The drying chamber is closed and a drying routine commences. During the drying routine, the chamber is pressurized to a vacuum level sufficient to gasify liquids inside the device, and the device is conductively heated at least to replace latent heat of vaporization lost during the pressurization. Some embodiments include techniques relating to payment processing, monitoring and feedback control, decontamination, and/or other functionality.

According to one set of embodiments, a drying system is provided for drying portable electronic devices. The system includes: a pressurization subsystem configured, when the portable electronic device is in a chamber, to produce a negative pressure environment within the chamber sufficient to gasify liquid in the portable electronic device; and a thermal conduction assembly configured, when the portable electronic device is in the negative pressure environment within the chamber, to substantially conform in three dimensions to an external shape of the portable electronic device and to conduct heat to the portable electronic device sufficient to at least overcome latent heat of evaporation resulting from the gasifying of the liquid in the portable electronic device.

According to another set of embodiments, a method is provided for drying portable electronic devices. The method includes: receiving a portable electronic device in a chamber in such a manner that causes a thermal conduction assembly to substantially conform in three dimensions around the portable electronic device, the portable electronic device having an excessive amount of liquid; pressurizing the chamber when the portable electronic device is in the chamber, so as to produce a negative pressure environment within the chamber sufficient to gasify the liquid in the portable electronic device at least until the portable electronic device no longer has the excessive amount of liquid; and heating the portable electronic device in the chamber conductively via the thermal conduction assembly during the pressurizing, the heating being at least sufficient to replenish latent heat of vaporization lost from the gasifying of the liquid.

BRIEF DESCRIPTION OF THE DRAWINGS

The present disclosure is described in conjunction with the appended figures.

Figure 1:
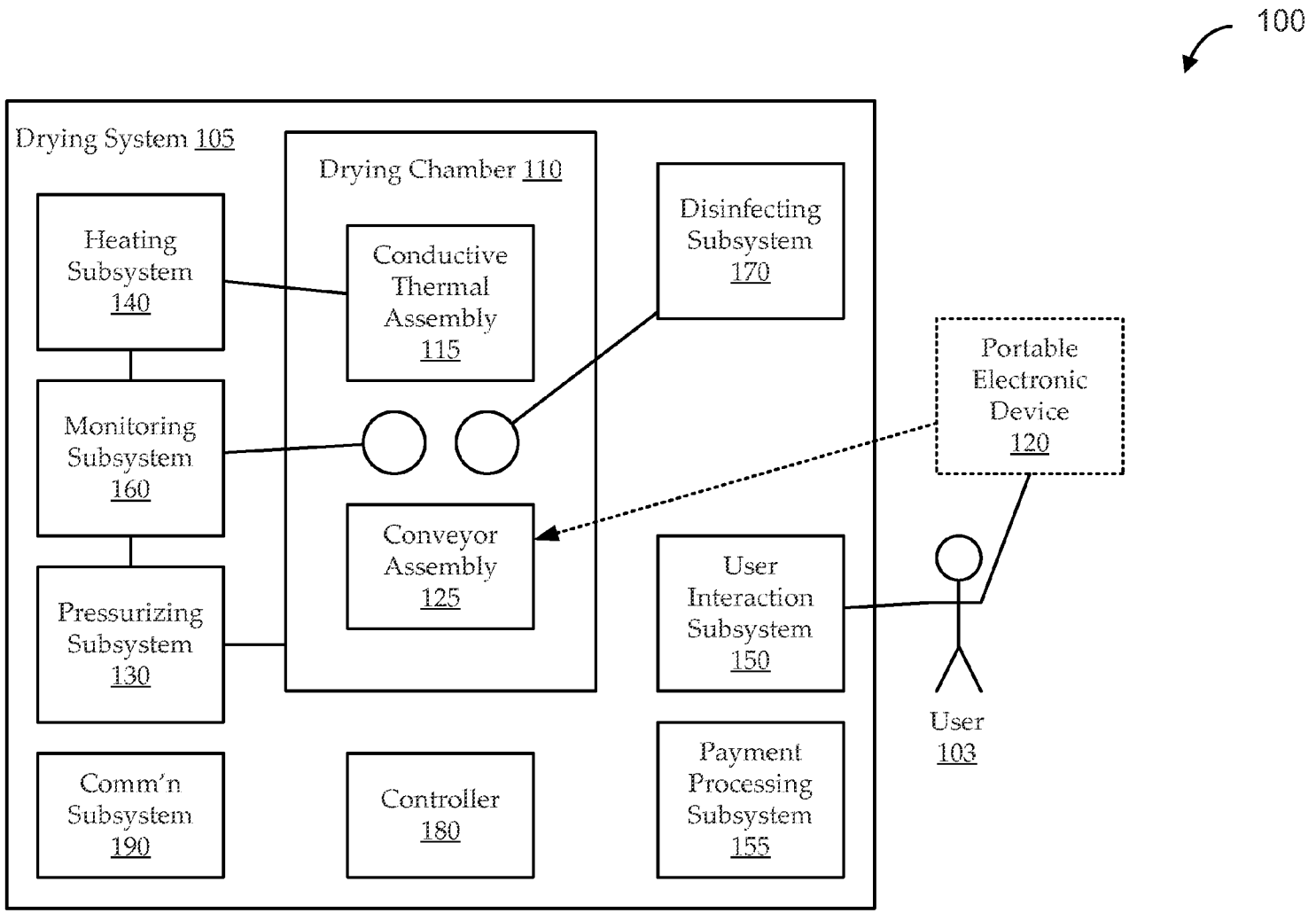
FIG. 1 shows an embodiment of a drying environment, according to various embodiments.

In the appended figures, similar components and/or features can have the same reference label. Further, various components of the same type can be distinguished by following the reference label with a second label that distinguishes among the similar components. If only the first reference label is used in the specification, the description is applicable to any one of the similar components having the same first reference label irrespective of the second reference label.

DETAILED DESCRIPTION

As people increasingly rely on their personal electronic devices, they also tend to have their devices with them more often in situations where water damage is likely to occur. Anecdotal data suggests that over-exposure to liquid (from spilling liquid on the device or dropping the device into liquid) is one of the most common causes of damage to personal portable electronic devices, like cell phones and portable computers. While many proposed remedies exist, they tend either to be ineffective or to be effective only in limited situations. For example, proposed remedies that fail to remove enough liquid from the device, or fail to remove the liquid quickly enough, can be ineffective and can even cause additional damage.

Various drying approaches tend to encourage evaporation through changes in temperature and/or pressure. For example, exposure to heat or exposure to negative pressurization (e.g., vacuum) can cause the liquid to gasify (e.g., boil, vaporize, sublimate, etc.). However, traditional drying approaches tend to be inapplicable and/or ineffective for drying portable electronic devices for a number of reasons. One such reason is that the devices often include a number of electronic components (e.g., processors, batteries, etc.) housed in a substantially sealed environment. The housing can frustrate attempts to remove the liquid (e.g., by limiting contact between internal components and absorptive materials) and can slow "normal" drying of the internal component (e.g., from ambient air). Still, it can be undesirable to open up the device to expose the internal components for drying, as that can cause further damage, break seals, void warranties, etc.

Another such reason is that, as liquid leaves the device (e.g., by evaporation), it can remove latent heat from the device, which can effectively freeze remaining liquid. This can further frustrate attempts to remove the remaining liquid from the device. Yet another such reason is that the devices are often made of materials that are sensitive to scratching, over-exposure to pressure and/or temperature, etc. For example, plastics or metals of different colors or finishes can respond differently to different temperatures, pressures, and/or contact with other materials. Similarly, a display screen can be easily scratched or cracked if exposed to certain environments. Accordingly, approaches that involve contact with certain types of materials, radiant heating, and/or other types of exposure can cause damage to the device being dried. Similarly, the devices often include various ports, sensors, and/or other components that have their own sensitivities. For example, small-sized particles can enter and damage a headphone jack. These and other considerations can constrain the types of drying techniques that can be used with these devices and can limit effectiveness of those techniques.

Embodiments provide novel systems and methods for drying a portable electronic device by immersing the device in a conductive heating assembly within a pressurized chamber. The chamber can apply negative pressure to cause any liquid on or in the device to gasify and leave the device, while the conductive heating assembly supplies heat to the device. In some implementations, the supplied heat can be enough to avoid freezing during removal of liquid from the device. In other implementations, additional heat is applied to the device to further aid the drying. Some embodiments of the conductive heating assembly are designed to gently and evenly supply conductive heat to the device without damaging the device, for example, through scratching, overheating, etc.

In the following description, numerous specific details are set forth to provide a thorough understanding of various embodiments. However, one having ordinary skill in the art should recognize that the invention can be practiced without these specific details. In some instances, circuits, structures, and techniques have not been shown in detail to avoid obscuring the present invention.

Turning first to FIG. 1, a block diagram is shown of an embodiment of a drying environment 100, according to various embodiments. The drying environment 100 includes a drying system 105 that can be used by users 103 to dry portable electronic devices 120. For example, the drying system 105 can be used to dry, and potentially to resuscitate, a portable electronic device 120 that has been overexposed to liquid and has stopped working. The portable electronic device 120 is placed into a drying chamber 110 (e.g., on a conveyor assembly 125) and contact is established with a conductive thermal assembly 115. Negative pressure (e.g., a partial vacuum) is applied to the drying chamber 110 by a pressurizing subsystem 130, and heat is applied to the portable electronic device 120 via the conductive thermal assembly 115 using a heating subsystem 140.

The drying environment 100 is used to dry any type of portable electronic device 120 (or similar type of device). For example, the portable electronic device 120 can be a cellular telephone, portable computer (e.g., tablet, laptop, etc.), portable music player, portable audio and/or video recording device (e.g., voice recorder, camera, video recorder, etc.), portable gaming device, etc. Typically, the portable electronic device 120 has exposure limits set by the manufacturer for one or more environmental conditions, such as temperature. For example, if the portable electronic device 120 can withstand relatively high temperatures, it may be possible to dry out the device simply in an oven at normal atmospheric pressure. However, many portable electronic devices 120, like smart phones, typically have relatively low exposure limits for temperature (e.g., 115 degrees Fahrenheit). Accordingly, embodiments use negative pressure (e.g., vacuum) to facilitate a "cool" flash boiling of liquid inside the portable electronic device 120, and a controlled, relatively low temperature is used to facilitate the drying while remaining well within the thermal exposure limits of the device.

Embodiments of the drying chamber 110 are manufactured in any suitable manner in any suitable size and of any suitable shape and material, so that desired types of portable electronic devices 120 can fit within the chamber and the chamber can support the types of negative pressure applied to it by the pressurizing subsystem 130. For example, the drying chamber 110 is made of metal or sturdy plastic and includes seals where appropriate to maintain appropriate levels of negative pressure within the drying chamber 110. Some implementations include multiple drying chambers 110 for concurrent drying of multiple portable electronic devices 120 or for drying of different sizes and/or shapes of portable electronic devices 120 (e.g., with correspondingly sized and/or shaped drying chambers 110). Some are designed to facilitate use within context of a larger assembly (e.g., a wall-mounted or case-integrated drying chamber 110). In one implementation, multiple drying chambers 110 are stacked in a configuration that allows access like a drawer, chest, etc.). Some implementations further include windows, internal lighting, and/or other features to allow users 103 to view the inside environment (e.g., during drying of their portable electronic devices 120).

The drying chamber 110 is pressurized by a pressurizing subsystem 130. Embodiments of the pressurizing subsystem 130 include a vacuum pump or the like for producing a negative pressure environment within the drying chamber 110. The specifications of the pressurizing subsystem 130 are selected to produce a desired vacuum level within a desired amount of time, given the air-space within the drying chamber 110, the quality of the drying chamber 110 seals, etc. In one embodiment, the pressurizing subsystem 130 includes a one-half-horsepower, two-stage vacuum pump configured to produce a vacuum level within the drying chamber 110 of approximately 0.4 inches of mercury ("in Hg") within seconds and to maintain substantially that level of pressure throughout the drying routine (e.g., for fifteen to thirty minutes). Different pressurizing subsystem 130 specifications can be used to support concurrent drying in multiple drying chambers 110, drying in drying chamber 110 of different sizes, use in portable versus hard-mounted implementations, etc.

In some embodiments, the pressurizing subsystem 130 is in fluid communication with the drying chamber 110 (or multiple drying chambers 110) via one or more fluid paths. For example, a fluid path can include one or more release valves, hoses, fittings, seals, etc. The fluid path components are selected to operate within the produced level of negative pressure. Certain embodiments include an electronically controlled (or manual in some implementations) release valve for releasing the negative pressure environment to allow the drying chamber 110 to be opened after the drying routine has completed (or at any other desirable time). In implementations including multiple drying chambers 110, multiple fluid paths, multiple release valves, or other techniques can be used to fluidly couple the pressurizing subsystem 130 with the drying chambers 110.

Pressurization of the drying chamber 110 by the pressurizing subsystem 130 causes liquid on and in the portable electronic device 120 to gasify (e.g., evaporate, vaporize, etc.). For example, liquid inside the housing of the portable electronic device 120 can become vaporized and can escape from various ports and other non-sealed portions of the housing. Evaporation of the liquid away from the portable electronic device 120 is an endothermic process (i.e., involving latent heat) that causes a temperature drop in the drying chamber 110 around the portable electronic device 120. This can frustrate (e.g., slow) the drying process.

Embodiments add heat to the drying chamber 110. In some implementations, the amount of heat added to the environment is only as much as sufficient to overcome the latent heat of vaporization. In other implementations, other amounts of heat are provided to the environment within the drying chamber 110. For example, additional heat can be added to speed up the drying process, or heat can be added in varying amounts over time for various purposes.

Traditional approaches to drying an object with heat (e.g., in other contexts) often involve convective or radiated heat transfer. Convective heating tends not to be useful in context of a negative pressure environment, as the substantial vacuum may not leave sufficient gas molecules in the drying chamber 110 to provide efficient or effective heat transport. Many laboratory and industrial drying ovens use radiated heat, which can be effective even in a vacuum so long as properties of the material being dried are known and are capable of withstanding the amount of radiated heat. Many typical portable electronic devices 120, however, include multiple types of materials, which can each vary widely with respect to maximum temperature ratings, absorbance of heat, etc. (e.g., due to different materials, finishes, colors, etc.). Experimentation by the inventors has demonstrated that these differences can often either limit the amount of radiated heat that can be applied to the portable electronic device 120 to an amount that is too low to be effective, can cause the portable electronic device 120 to absorb too much heat in one region and not enough in another, etc.

Some other traditional approaches operate like a stove or hot plate, applying conductive heat through a flat plate. This type of approach typically involves applying all the desired heat via a single face of a device that is in contact with the plate, and can tend to heat the device unevenly and excessively. Using such an approach, it can be difficult in many contexts to provide sufficient heat to facilitate rapid drying of the device without damaging the device in the process, for example, due to sensitivity of many portable electronic devices to overheating. The effectiveness can be further frustrated by the tendency of many heat-sensitive components to be located on or near the flat faces of portable electronic devices (e.g., screens, camera lenses, plastic or rubberized features, etc.).

Embodiments described herein use substantially conforming, conductive heat to provide heating to the portable electronic device 120 within the drying chamber 110. A heating subsystem 140 heats a conductive thermal assembly 115, which is in contact with the portable electronic device 120 and configured to conduct heat to the portable electronic device 120. In various implementations, the heating subsystem 140 can heat the conductive thermal assembly 115 while it is in contact with the portable electronic device 120 and/or prior to the conductive thermal assembly 115 being in contact with the portable electronic device 120. For example, the heating subsystem 140 can heat the conductive thermal assembly 115 to a desired temperature, and the heating subsystem 140 can stop generating heat and/or the conductive thermal assembly 115 can be removed from contact with the heating subsystem 140 prior to placing the conductive thermal assembly 115 in thermal contact with the portable electronic device 120. In such implementations, the conductive thermal assembly 115 can be configured to store heat sufficiently to maintain application of at least a desired amount of heat to the portable electronic device 120 during the vacuum process. For example, the conductive thermal assembly 115 can include thermally conductive beads of a material that manifest a sufficient specific heat to at least overcome the latent heat of evaporation during the vacuum process, even when no further heat is applied to the conductive thermal assembly 115.

Implementations of the conductive thermal assembly 115 at least partially conform to an external shape of the portable electronic device 120 so as to at least partially surround the portable electronic device 120. As used herein, phrases like "substantially conform," "at least partially conform," "at least partially surround," or "in conformed contact" are intended to mean conformance in three dimensions (e.g., in more than a single plane). For example, the conductive thermal assembly 115 can be designed so that the portable electronic device 120 is gently immersed in, sandwiched between, or otherwise in conformed contact with elements of the conductive thermal assembly 115. The conforming can be dynamic (e.g., as with a number of conductive beads or some other assembly that dynamically changes shape to at least partially surround a portable electronic device 120) or static (e.g., as with a molded component configured to simultaneously encase or contact multiple faces of the portable electronic device 120). For example, in contrast to a conductive plate, the conductive thermal assembly 115 can at least partially surround the device with the conductive heat to provide a gentle, conforming heat.

In one implementation, the conductive thermal assembly 115 includes a number of thermally conductive beads. For example, the drying chamber 110 is partially filled with small aluminum spheres sized to be small enough to substantially conform to the shape of the portable electronic device 120 when the device is placed in the beads (e.g., partially or fully submerged into the bed of beads). The aluminum spheres are also sized to be larger than any port or opening in the portable electronic device 120. Bead size can be selected in accordance with features of a particular portable electronic device 120 or standard features across multiple portable electronic devices 120, minimum or maximum standard feature sizes, or in any other suitable manner. For example, it can be desirable to use small beads to maximize thermal contact with irregular portions of the exterior shape of the portable electronic device 120 (e.g., an empty battery compartment, curves or bevels, etc.), while ensuring that the beads are large enough to avoid getting stuck in typical cavities (e.g., ports for headphones, memory cards, power and/or data cables, hinge mechanisms, etc.). The heating subsystem 140 can heat the drying chamber 110 from the outside (e.g., from the bottom and/or sides of the drying chamber 110). The applied heat from the heating subsystem 140 is conducted toward the portable electronic device 120 via the beads, permitting the heat to evenly and gently surround at least a portion of the portable electronic device 120. Experimentation by the inventors has demonstrated that the beads tend to store heat in their mass, so that cooling from the latent heat of vaporization can be counteracted by heat stored in the beads adjacent to the portable electronic device 120. Some implementations select beads having relatively high thermal capacity (e.g., storage), which can tend to provide a steady flow of heat to the portable electronic device 120 without exceeding maximum temperature limits. For example, beads with low thermal conductivity and/or low heat storage capacity can tend to allow cold regions to form around the portable electronic device 120 as the liquid gasifies, potentially quenching the gasification of the liquid once the temperature drops below a phase change temperature at that level of vacuum. In context of those low thermal conductivity and/or low heat storage capacity beads, further increases in heat could have limited impact due to the low thermal conductivity of the beads, and could potentially conduct a "slow wave" of too much heat and cause damage to the portable electronic device 120.

For the sake of illustration, various potential materials are analyzed for use as beads in the following table:

| Material | Specific Heat | Conductivity (W/m ° K) | Softness (10 - hardness) | Score (Factor Product) |
|---|---|---|---|---|
| Magnesium | 1.05 | 156 | 8 | 1310.4 |
| Aluminum | 0.87 | 205 | 7.1 | 1266.3 |
| Copper | 0.39 | 401 | 7 | 1094.7 |
| Sodium | 1.26 | 84 | 9.6 | 1016.1 |
| Gold | 0.13 | 310 | 7 | 282.1 |
| Brass | 0.38 | 109 | 6 | 248.5 |
| Cadmium | 0.25 | 92 | 8 | 184.0 |
| Iridium | 0.13 | 147 | 3.5 | 66.9 |
| Antimony | 0.21 | 18.5 | 6.7 | 26.0 |
| Asphalt | 0.92 | 0.75 | 8 | 5.5 |
| Glass | 0.84 | 1.05 | 3.5 | 3.1 |
| Mica | 0.50 | 0.71 | 7.2 | 2.6 |
| Styrofoam | 1.30 | 0.03 | N/A | N/A |
| Rubber | 2.01 | 0.045-0.13 | N/A | N/A |
| Sand (dry) | 0.84 | 0.15-0.25 | N/A | N/A |
| Rice | 1.20 | 0.08-0.1 | N/A | N/A |

The above table evaluates three criteria of different materials: specific heat, conductivity, and softness. It is worth noting that the "softness" values in the table are derived from the so-called Mohs hardness scale for elements, and neither softness values nor the scores that depend therefrom are included in the table for the non-element entries. The specific heat and conductivity indicate the material's ability to store and conduct heat, and the softness indicates whether the material is likely to damage portions of the drying environment 100 (e.g., surface coatings, displays, etc.) or portions of the portable electronic device 120. In some implementations, a single criterion is used to select an appropriate material. In other implementations, a score is calculated as the simple product of the three criteria values (i.e., with no weighting). Still other implementations use different criteria and/or weight the criteria in different ways. For example, certain other criteria may relate to ease of manufacturing, access, cost, susceptibility to contamination, ease of cleaning, etc. In an illustrative implementation based on the above table, while magnesium achieved a slightly better score than aluminum, aluminum was chosen as a more cost-effective option. In some embodiments, custom alloys, composites, and/or other materials are used to achieve better scores, according to the above and/or different criteria. Each of the above and/or other criteria can be evaluated in any suitable manner. For example, experimentation with a number of materials has demonstrated that materials having a thermal conductivity of less than about 0.5 W/m° K. (Watts×1/meters×1/degrees Kelvin) (e.g., sand, rice, rubber, etc.) tend not to conduct sufficient heat to be useful as thermally conductive beads in the contexts described herein. Experimentation has also demonstrated deficiencies with many common types of heating packs. For example, some heat packs are essentially bags filled with sand, rice, or other materials that are appreciably more thermally conductive when wet. Such materials tend to release moisture during heating. While this trait can make such materials attractive for therapeutic and/or other applications, such a "wet" heat is typically undesirable to use in a drying context. Some other heat packs are essentially bags of conductive gel. Experimentation has demonstrated that gels of the type used in conventional therapeutic gel packs tend to expand in a vacuum, which can cause the gel packs to rupture or explode under the types of negative pressures experienced in embodiments described herein. While such conventional gel packs tend to be unusable, some embodiments include gel packs specially designed or modified to conduct sufficient heat, while substantially conforming to the portable electronic device 120 during heating and avoiding rupturing under the types of negative pressure used for drying.

In various embodiments, certain materials that are ineffective at heating in these contexts can be used along with other effective materials in some implementations. For example, one implementation of a conductive thermal assembly 115 can include some beads having relatively low thermal conductivity, but relatively high specific heat (e.g., to facilitate sufficient storage of heat from the heating subsystem 140); and other beads having relatively high thermal conductivity, but relatively low specific heat (e.g., to facilitate transfer of heat to from the "storage" beads to the portable electronic device 120). Another implementation of a conductive thermal assembly 115 can include some beads with sufficiently high thermal conductivity and specific heat (e.g., metallic beads); and other beads that may not be conductive, but increase the conformance of the conductive thermal assembly 115 to the portable electronic device 120 (e.g., rubber or plastic beads, foam, or other material that help the conductive beads conform to the shape of the portable electronic device 120 and help establish thermal contact thereto). Another implementation of a conductive thermal assembly 115 can intersperse thermally conductive beads with beads that are substantially transparent to one or more frequencies of radiation. For example, glass or clear plastic beads can be interspersed with metallic beads in sufficient quantity to allow the portable electronic device 120 to be irradiated with ultraviolet radiation or some other radiation that facilitates disinfecting of the portable electronic device 120, the beads, and/or other components of the drying environment 100.

Bead geometry can also be selected based on various considerations. One such consideration is the opening size of the portable electronic device 120. It is desirable to keep beads from entering any ports, sockets, or other openings in the portable electronic device 120. For example, a smart phone has a 3.5-millimeter headphone jack, and the next-largest available common size for aluminum balls is chosen (e.g., six-millimeter BBs). Another such consideration is that increasing contact surfaces can increase heat conduction. For example, dodecahedron and other regular polyhedrons may provide more conduction than a sphere or other shape and can be selected accordingly. The shape can be selected to provide more conduction surface with the portable electronic device 120 and/or with the heat source (e.g., walls of the drying chamber 110). Still another such consideration is to shape the beads to permit conformance with the exterior geometry of the portable electronic device 120. For example, a smart phone may have an irregular shape (particularly if a battery is removed). Further, new portable electronic devices 120 are entering the market all the time, including new smart phones with curved screens and other non-planar features, other personal interface devices (e.g., watches or headsets that interface with smart phones, fitness or health tracking bands, etc.), etc. Conduction to a flat surface or very large beads on which the phone is placed may only heat some or all of a single surface of the phone (or less where the phone does not have any flat surfaces, or where the only flat surfaces include heat-sensitive components), while smaller beads can allow the phone to be partially or fully immersed within the conductive elements.

In some implementations, the portable electronic device 120 is first placed in a heat-conductive shield before being placed in the drying chamber 110 with the beads. The heat conductive shield can protect the surface of the portable electronic device 120 from scratches or other damage caused by contact with the beads and/or can further distribute the heat from the beads. For example, a smart phone can be encased in a paper wrap prior to submerging the phone in the beads. The heat-conductive shield can also facilitate wicking of moisture away from the portable electronic device 120. For example, the paper wicks moisture away from the phone as it dries, which can mitigate formation of stains or "water spots" on the surface of the phone as the liquid escapes the phone and evaporates. Some implementations use specially designed beads that aid with moisture wicking and/or absorption.

Various embodiments can include different numbers, materials, shapes, sizes, etc. of beads. Some implementations include a conveyor assembly 125 configured to hold the portable electronic device 120 in place within the conductive thermal assembly 115. For example, the conveyor assembly 125 can include a tray, clips, frame, etc. for supporting the portable electronic device 120. Alternatively, the conveyor assembly 125 can be features of the drying chamber 110, for example, protrusions from the wall or floor of the drying chamber 110. Some implementations of the conveyor assembly 125 move the portable electronic device 120 into (and/or out of) place within the drying chamber 110 as appropriate. For example, the portable electronic device 120 can be placed on the conveyor assembly 125 when the drying chamber 110 is open, and closing the drying chamber 110 can cause the conveyor assembly 125 to move the portable electronic device 120 into contact with the conductive thermal assembly 115.

In some implementations, the portable electronic device 120 is maintained (e.g., secured) in a location within the drying chamber 110, and the beads are introduced into the drying chamber 110. For example, the drying chamber 110 has a port, and turning the entire drying chamber 110 causes the beads to pour into the drying chamber 110 from a reservoir at the beginning of the drying routine and/or to pour out of the drying chamber 110 at the end of the drying routine (e.g., before or after heating the beads). The reservoir approach and/or other similar approaches can allow different types or amounts of beads to be introduced into the drying chamber 110 for different applications; can help mitigate theft of the beads (e.g., if made of valuable material, if the drying system 105 is placed in a public facility, etc.); can facilitate cleaning, cooling, disinfecting, etc. of the beads between uses; etc.

While the above embodiments are described with reference to beads, many other types of conductive thermal assembly 115 are possible. For example, some implementations involve partially or fully immersing the portable electronic device 120 in other types of relatively small objects (or a substance, like a highly viscous liquid, a foam, etc.) to substantially conform to the geometry of the portable electronic device 120 and to transfer heat from the heating subsystem 140 evenly and gently through conduction. A number of alternate types of conductive thermal assembly 115 can be used in other implementations.

Figure 2A:
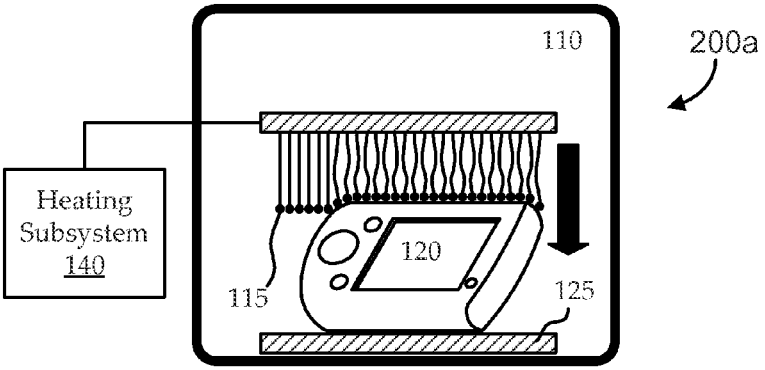
FIGS. 2A-2E show partial drying environments having illustrative types of conductive heating assemblies, according to various embodiments.

One category of alternate conductive thermal assemblies 115 still uses beads, but further supports the beads in some manner. One such implementation is illustrated in FIG. 2A. As shown, a structure (e.g., a plate or frame) is included in an upper portion of the drying chamber 110, from which a number (e.g., tens or hundreds) of beads hang. For example, each bead (or each small group of beads) is suspended from the structure by a wire (e.g., any heat-conductive, flexible material). The beads can be suspended at one or more heights. The resulting "hanging clump" of beads acts as the conductive thermal assembly 115 and can be placed into contact with the portable electronic device 120 in such a way that the beads are allowed to substantially conform to the geometry of the portable electronic device 120 and conduct heat thereto. For example, the portable electronic device 120 is raised into the beads, or the beads are lowered onto the portable electronic device 120. The beads can receive heat from the heating subsystem 140 directly, through the structure, or in any other suitable manner.

Figure 2B:
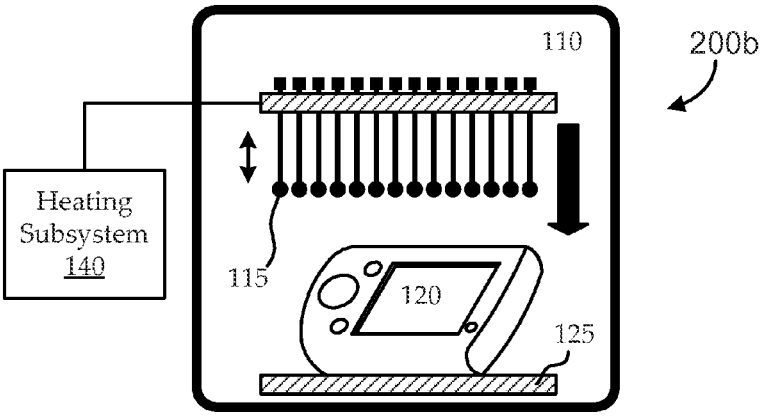

Another such implementation is illustrated in FIG. 2B. As shown, a structure (e.g., a plate or frame) is included in an upper portion of the drying chamber 110, through which a number (e.g., tens or hundreds) of pins (e.g., blunt nails, beads on posts, etc.) pass. The structure permits the pins to float in an extended position using gravitational force. For example, each pin passes through a corresponding hole in the structure and includes at least one wide end (i.e., wider than the through hole) to limit the motion of the pin with respect to the structure. The resulting "pin wall" acts as the conductive thermal assembly 115 and can be placed into contact with the portable electronic device 120 in such a way that the pins are allowed to substantially conform to the geometry of the portable electronic device 120 and conduct heat thereto. For example, the portable electronic device 120 is raised into the pins, or the pins are lowered onto the portable electronic device 120. The pins can receive heat from the heating subsystem 140 directly, through the structure, or in any other suitable manner. It is worth noting that "thermally conductive beads," as used herein, generally include any suitable shape and size of thermally conductive elements. For example, the hanging clump of beads, the pins, and other implementations can all generally be considered as a plurality of thermally conductive beads.

Figure 2C:
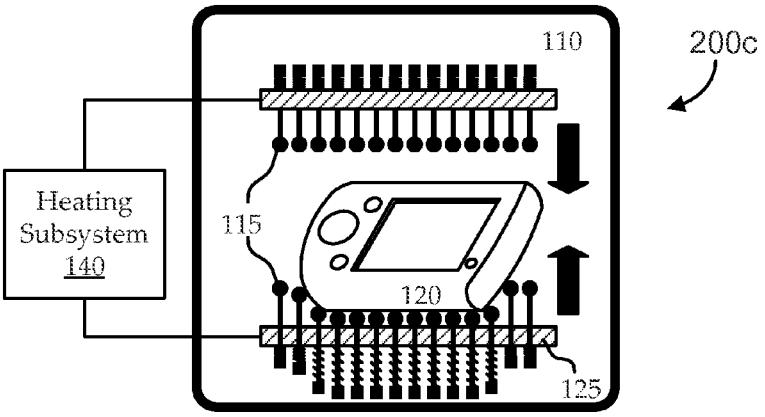

Another similar implementation is illustrated in FIG. 2C. As shown, one or multiple structures are included in one or more portions of the drying chamber 110 (e.g., top, bottom, and/or sides of the drying chamber 110), through which a number (e.g., tens or hundreds) of spring-loaded pins pass. The springs hold the pins in an extended position when not being depressed by the geometry of the portable electronic device 120. The resulting "spring-loaded pin wall" can be placed into contact with the portable electronic device 120 in such a way that the pins are allowed to substantially conform to the geometry of the portable electronic device 120 and conduct heat thereto, for example, as discussed above.

Figure 2D:
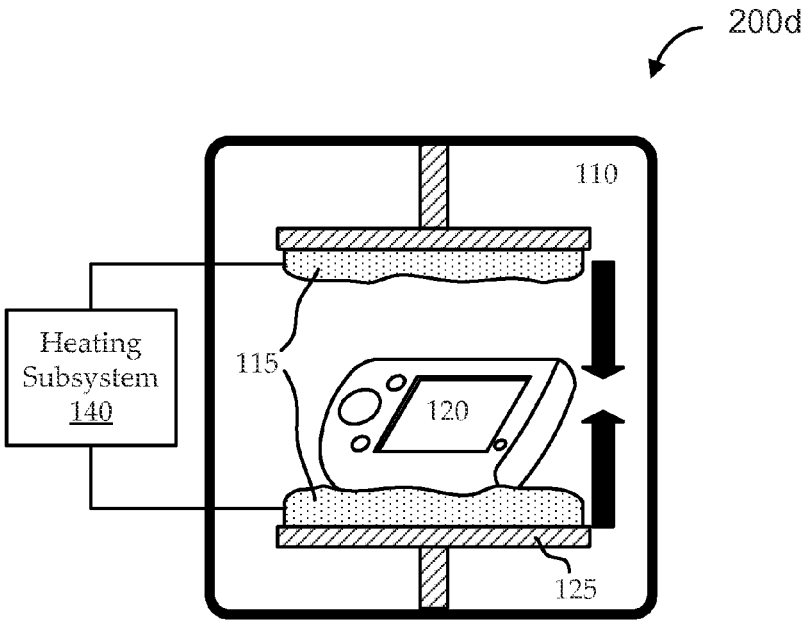
Figure 2E:
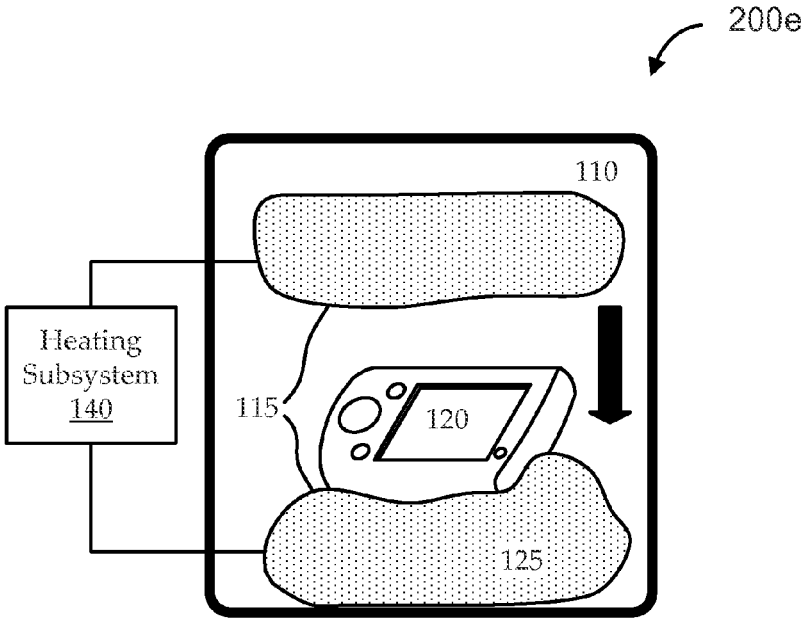

Yet other implementations are illustrated in FIGS. 2D and 2E. As shown, one or more "heat packs" are included in one or more portions of the drying chamber 110. The heat packs can be supported and/or transported by structures (e.g., as in FIG. 2D), or the heat packs can be freely placed inside the drying chamber 110 (e.g., as in FIG. 2E). Each heat pack includes a receptacle configured to conduct heat to the portable electronic device 120 from within the heat pack and to substantially conform to the geometry of the portable electronic device 120. In some implementations, the heat pack is filled with beads or the like. This can provide similar features to the bead-related implementations discussed above, while reducing issues involving bead maintenance, transport, security, etc. In other implementations, as described above, the heat pack can includes a gel or other heat-conductive substance, with the receptacle specially designed or modified to substantially conform to the portable electronic device 120 during heating while avoiding rupturing under the types of negative pressure used for drying. In some embodiments, the receptacle is made from a material that will not scratch or otherwise harm the surface of the portable electronic device 120. Some receptacles are further designed to help wick moisture away from the portable electronic device 120 as it leaves the device. The heat packs can be placed around the portable electronic device 120, the portable electronic device 120 can be moved (e.g., by a conveyor assembly 125) into contact with the heat packs, the heat packs can be in the form of a sock or other further receptacle into which the portable electronic device 120 can be placed, or the heat packs can thermally communicate with the portable electronic device 120 in any other suitable manner. The heat packs can be pre-heated by the heating subsystem 140 (e.g., prior to the drying routine), heat can be delivered to the heat packs from the heating subsystem 140 during the drying routine, and/or the heat packs can have integrated heating elements. In some implementations, combinations of heating elements can be used. For example, the portable electronic device 120 may be sandwiched between a heating tray and a heat pack.

Returning to FIG. 1, other subsystems are used in some embodiments to provide additional functionality. Some embodiments include a monitoring subsystem 160 that can provide feedback control, environmental monitoring within the drying chamber 110, monitoring of the portable electronic device 120, etc. Implementations of the monitoring subsystem 160 include one or more probes, sensors, cameras, and/or any other suitable device. In one embodiment, the monitoring subsystem 160 includes one or more sensors situated inside the drying chamber 110 and configured to monitor internal pressure (vacuum level), humidity, and temperature within the drying chamber 110. For example, the measurements can be used to determine if the heating is sufficient to overcome the latent heat of vaporization, to determine if the vacuum level is sufficient, to determine when the portable electronic device 120 has dried sufficiently, etc.

The monitoring subsystem 160 can communicate its measurements through wired and/or wireless communications links to a controller 180 located outside the drying chamber 110. For example, the controller 180 includes memory (e.g., non-transient, computer-readable memory) and a processor (e.g., implemented as one or more physical processors, one or more processor cores, etc.). The memory has instructions stored thereon, which, when executed, cause the processor to perform various functions. The functions can be informed by (e.g., directed by, modified according to, etc.) feedback from the monitoring subsystem 160. For example, the measurements from the monitoring subsystem 160 can be used to determine when to end the drying routine and release a pressure release valve of the drying chamber 110, when and how to modify the heat being delivered to the conductive thermal assembly 115, etc. The controller 180 can also direct operation of other subsystems, such as the conveyor assembly 125, pressurizing subsystem 130, etc.

In some embodiments, the monitoring subsystem 160 includes a camera configured to "watch" the internal environment of the drying chamber 110. In one implementation, the camera is used to monitor the vaporization of liquid from the portable electronic device 120. In another implementation, the camera uses infrared to indicate internal temperature readings from within the drying chamber 110 and/or around the surface of the portable electronic device 120. In yet another implementation, the camera can monitor functionality of the portable electronic device 120 within the drying chamber 110. For example, portable electronic device 120 may be plugged in within the drying chamber 110, and a signal can be sent to the portable electronic device 120 (e.g., a text message can be sent to the device) within the drying chamber 110 to see if the device reacts. The camera can be used to visually monitor the reaction to determine whether the portable electronic device 120 was successfully resuscitated. In some implementations, the camera is used for other functions, for example, to capture "before" imagery of the portable electronic device 120 to help determine whether the portable electronic device 120 had pre-existing conditions (e.g., a cracked screen) prior to using the drying system 105.

In support of that and/or other functionality, some embodiments of the monitoring subsystem 160 include one or more interface cables. The interface cable can connect the portable electronic device 120 to a power source, a storage device, a communications network, a remote interface, etc. to allow operation of the portable electronic device 120 to be monitored, verified, or even exploited. For example, the interface cable can be used to charge the portable electronic device 120 during the drying routine or to provide power when the battery is removed. In some implementations, the functionality of the portable electronic device 120 is verified at the end of the drying routine to determine appropriate next steps. For example, when it is determined that the portable electronic device 120 has not been resuscitated (i.e., it remains non-functional after drying), the drying system 105 can provide the user 103 with a partial refund, a coupon for related or unrelated services, etc. Alternatively, a repair fee is only collected from the user 103 after functionality is verified. In some embodiments, the interface cable is used to extract information from the portable electronic device 120. For example, an identification number, network provider, phone number, email address, user identity, and/or other information can be extracted for tracking and/or other purposes.

Some embodiments of the drying system 105 further include a disinfecting subsystem 170 for disinfecting the portable electronic device 120, the conductive thermal assembly 115, and/or the drying chamber 110. In one such embodiment, the disinfecting subsystem 170 includes an ultraviolet lamp, or the like. It is common for the surfaces of portable electronic devices 120 to be rife with bacteria, pathogens, and other contaminants (e.g., from daily use, from dropping the device into a toilet, etc.). The lamp can irradiate the internal environment of the drying chamber 110 to help kill many of the contaminants. For example, the conductive thermal assembly 115 can be configured to permit radiation from the lamp to irradiate the portable electronic device 120. In other implementations, nozzles and/or other components are used to spray or otherwise distribute disinfectants (e.g., solutions of alcohol, bleach, etc.) into the drying chamber 110 in the presence and/or absence of the portable electronic device 120. As described above, some embodiments include a reservoir or repository for components of the conductive thermal assembly 115 that can be separate from the drying chamber 110. The disinfecting subsystem 170 can be configured to disinfect those additional reservoirs, repositories, etc. in the presence or absence of the conductive thermal assembly 115 components. In one implementation, the drying chamber 110 partially fills with a disinfecting solution (e.g., an alcohol solution) to bathe the portable electronic device 120 at the start of the drying process. The solution is evacuated from the chamber and is quickly boiled off of and out of the portable electronic device 120 during the drying routine (e.g., the solution can also be formulated to facilitate faster evaporation, to help draw other liquids from the portable electronic device 120, etc.). In addition to disinfecting, using an additional solution at the start of the process can help with the resuscitation of portable electronic device 120 that have been exposed to liquids other than water that could otherwise leave a residue (e.g., coffee, soda, etc.). For example, various detergents, etc. can be included in the solutions that are formulated to facilitate the above functionality. It is noted that some embodiments of the drying system 105 permit users to exploit the disinfecting subsystem 170 even when the portable electronic device 120 was not otherwise over-exposed to liquid. For example, to disinfect a dry portable electronic device 120, the dry device can be placed in the drying chamber 110, bathed or exposed to disinfecting radiation or solution, and dried (if needed).

Some embodiments of the drying system 105 further include a user interaction subsystem 150 that facilitates user 103 interaction with functions of the system (e.g., using one or more displays, interface devices, payment interfaces, etc.). In some implementations, functionality of the user interaction subsystem 150 is facilitated by the controller 180. In other implementations, the user interaction subsystem 150 is a dedicated system in communication with the controller 180. For example, the user interaction subsystem 150 can be implemented as a tablet computer or other self-contained system with at least one interface (e.g., wired or wireless) between it and other components and subsystems of the drying system 105 (e.g., the controller 180). Some embodiments of the user interaction subsystem 150 include or are in communication with a payment processing subsystem 155, as described more fully below. Embodiments can also perform other functions by exploiting communications functionality through a communications subsystem 190. For example, certain functionality can be performed via the "cloud" or any suitable public or private network, as described more fully below.

Embodiments of the user interaction subsystem 150 can be designed to perform many different types of functions, depending, for example, on the particular implementation of the drying system 105. For example, different models can support different functions, and different models can be tailored for implementation as a wall-mounted system in a business establishment (e.g., a form factor similar to an automated teller machine (ATM) or automated external defibrillator (AED)), as a portable drying system in a case (e.g., a briefcase or toolbox form factor), etc.

Figure 3:
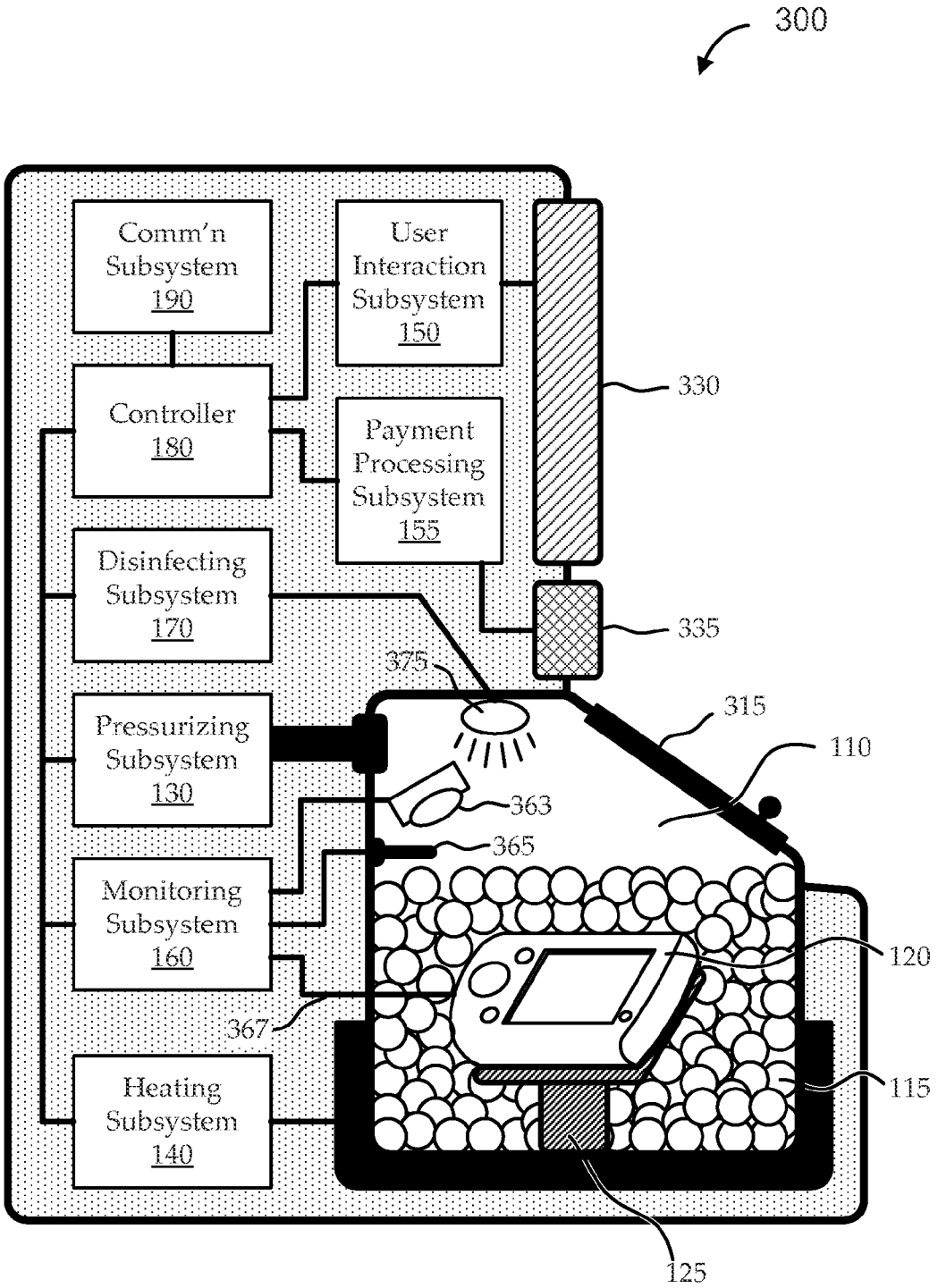
FIG. 3 shows an embodiment of a drying system implemented as a wall-mounted system in a business establishment.

For the sake of illustration, FIG. 3 shows an embodiment of a drying system 300 implemented as a wall-mounted system in a business establishment in a form factor similar to an automated teller machine (ATM). The drying system 300 can be a non-limiting embodiment of drying system 105 of FIG. 1, and its components are described using the same reference numbers, where appropriate, for the sake of added clarity. The housing of the drying system 300 is designed to receive portable electronic devices 120 into the drying chamber 110 via a door 315. For example, the door 315 is exposed in front of the housing and includes any gaskets or other seals to allow the drying chamber 110 to be sufficiently sealed when the door 315 is closed and the drying chamber 110 is pressurized. A similar form factor can be designed to support multiple drying chambers 110 for concurrent drying (and/or disinfecting) of multiple portable electronic devices 120 and/or for drying of multiple types of portable electronic devices 120.

The drying chamber 110 is pressurized by a pressurizing subsystem 130 (e.g., a vacuum pump or the like in fluid communication with the drying chamber 110 via suitable hoses, seals, valves, etc.). A heating subsystem 140 is coupled with the drying chamber 110 in such a way as to provide heat to a conductive thermal assembly 115 inside the drying chamber 110. As illustrated, the conductive thermal assembly 115 is a number of thermally conductive beads. The drying chamber 110 is configured with a conveyor assembly 125 to receive the portable electronic device 120 in a position that allows the beads of the conductive thermal assembly 115 to substantially conform to at least a portion of the portable electronic device 120 geometry and to conduct heat from the heating subsystem 140 to the portable electronic device 120 via the conductive thermal assembly 115.

The illustrated embodiment includes a monitoring subsystem 160 that can provide feedback control, environmental monitoring within the drying chamber 110, monitoring of the portable electronic device 120, etc. The illustrated monitoring subsystem 160 includes one or more probes 365 (e.g., for monitoring internal pressure, humidity, and temperature within the drying chamber 110) and one or more cameras 363 (e.g., for visualizing the internal environment of the drying chamber 110 and/or visualizing the portable electronic device 120 before, during, and/or after the drying routing). The illustrated monitoring subsystem 160 also includes an interface cable 367 for interfacing the drying system 300 with the portable electronic device 120 in the drying chamber 110 (e.g., for sending and/or receiving communications between the controller 180 and the portable electronic device 120). The illustrated embodiment of the drying system 300 also includes a disinfecting subsystem 170 for disinfecting the portable electronic device 120, the conductive thermal assembly 115, and/or the drying chamber 110. The disinfecting subsystem 170 includes an ultraviolet lamp 375 for irradiating the internal environment of the drying chamber 110 to help kill contaminants. The various subsystems of the drying system 300 are in communication with a controller 180 through a bus or any other suitable wired or wireless link. For example, the controller 180 can be implemented as a central processing unit of the drying system 300 or as a set of distributed processors, memories, etc.

The illustrated embodiment of the drying system 300 further includes a user interaction subsystem 150 that facilitates interaction by users with functions of the system. As shown, the user interaction subsystem 150 includes a display 330 and a payment interface 335. The user interaction subsystem 150 includes or is in communication with a payment processing subsystem 155 that processes payments through the payment interface 335. The payment interface 335 can accept payments in any suitable manner, for example, using a magnetic stripe interface, a currency acceptor interface, a radiofrequency-based payment interface, etc. In some implementations, the payments are processed at least in part through communications with one or more payment networks via the communications subsystem 190. Further, in various embodiments, the payments can be accepted and/or processed before, during, and/or after the drying routine. For example, payment can be pre-authorized at the beginning of the routine, but not fully processed until after the routine successfully completes. Certain implementations of the payment processing subsystem 155 can provide additional functionality, such as issuing and/or printing coupons, receipts, etc. In some embodiments, the payment interface 335 (or any other suitable interface) is used to "unlock" the drying chamber 110 after the routine completes to allow a user to retrieve the portable electronic device 120. For example, in a commercial implementation (e.g., in a commercial establishment with one or more drying chambers 110), it may be desirable to force the user to validate his or her identity to prevent theft of portable electronic devices 120 from the drying system 300 or to prevent a user from retrieving the wrong device. Accordingly, the user can be prompted to provide a payment instrument at the beginning of the routine and to present the same payment device at the end of the routine (or to present a printed receipt, confirmation code, etc.).

A user can interact with functions of the drying system 300 through a graphical user interface (GUI) and/or through any other user controls (e.g., buttons, switches, keypads, etc.). For example, the GUI is displayed on the display 330, which includes one or more touchscreens. In some implementations, the user interaction subsystem 150 provides minimal functionality (e.g., a button to begin the drying process). In other implementations, the user interaction subsystem 150 provides complex functionality. For example, the user interaction subsystem 150 can display information, including multiple selections (e.g., soft buttons that provide the user with various options), routine progress (e.g., an estimated time remaining for completion), payment information, video feeds (e.g., from inside the drying chamber 110, of the display of the portable electronic device 120, etc.), measured environmental levels (e.g., current readings of temperature, pressure, and/or humidity from within the drying chamber 110), and/or any other useful information.

For the sake of illustration, a user with a water-damaged smart phone enters a coffee shop that has a drying system 300 mounted on its wall. The user is presented with a GUI via the display 330 that provides a number of selections, for example, "rescue your wet phone," "disinfect your phone," or "rescue and disinfect your phone." Each option has an associated cost. The user selects one of the options and inserts a credit card. The door 315 of the drying chamber 110 opens, and the conveyor assembly 125 moves into an accessible position. The display instructs the user to place the phone on the conveyor assembly 125 and to connect the phone to the interface cable 367. The display may further prompt the user to agree to a waiver, etc. When the drying system 300 detects that the phone is properly placed on the conveyor and connected to the interface cable 367, a soft button appears on the GUI prompting the user to "press to start." The user touches the button. In response, the door 315 closes and locks (e.g., and seals), the conveyor assembly 125 moves the phone into contact with the conductive thermal assembly 115 (e.g., submerges the phone into the beads), and the routine begins. The pressurizing subsystem 130 produces a sufficient vacuum within the drying chamber 110 to gasify the water in and on the phone, while the heating subsystem 140 conducts heat gently and evenly to the phone via the beads to support the drying routine. Meanwhile, the display 330 shows an elapsed time, an estimated remaining time, and a measured value of the temperature and humidity around the phone in the chamber. The display 330 can also show advertisements or any other useful information. When the routine completes, an indication is provided to the user (e.g., audible, visual, etc.). In some implementations, when the routine completes, a signal is sent to the phone (e.g., a text message, phone call, or other type of signal) to verify (e.g., electronically through the interface cable 367, visually through the camera 363, etc.) that the phone is now operational. The user is prompted to insert credentials (e.g., the credit card used to begin the routine, any recognized form of identification, a code, etc.), and the credentials are authenticated. In response to authenticating the credentials, a payment transaction completes, a pressure valve releases, and the user is permitted to open the door 315 to retrieve the phone. For example, if the routine is unsuccessful, the user may not be charged or the user is charged a discount. In some implementations, for example during the routine or if the routine is unsuccessful, the drying system 105 issues a coupon to the user for merchandise at the coffee shop (e.g., a free cup of coffee).

Many other functions can be provided via the various subsystems in embodiments. For example, the user interaction subsystem 150 can be used to access maintenance, setup, diagnostics, debugging, and/or other functions. Further, the user interaction subsystem 150 can be used to receive various types of data from a user, like demographic information, discount codes, etc. For example, implementations collect various types of customer relationship management (CRM) data and the like. Similarly, embodiments can collect operational information, such as frequency of use, frequency of success, cycle times, time since last maintenance, system location (e.g., as installed, or tracked if implemented as a mobile system), error codes for diagnostics, etc. The data can be communicated (via the communications subsystem 190) to a host system (e.g., in the cloud, at a third-party location, etc.). Embodiments can also permit remote access (via the communications subsystem 190) for handling maintenance, diagnostics, updates, etc. In some implementations, payment processing, CRM, and/or other functions can be integrated with other systems. For example, if the drying system is installed in a hotel, embodiments can integrate with hospitality systems, such as the hotel's billing, reservations, customer management, and/or other systems.

Figure 4:
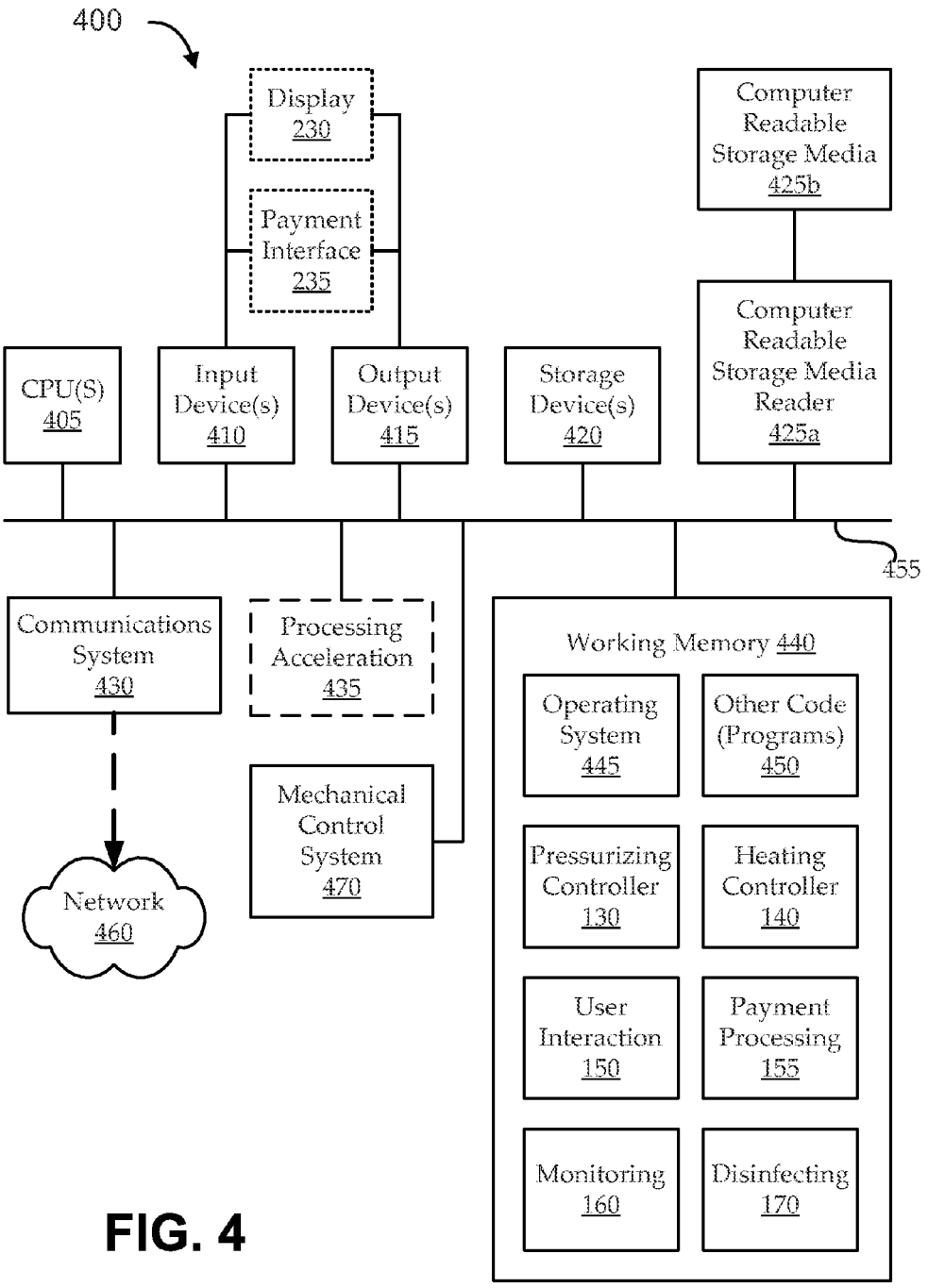
FIG. 4 shows an illustrative computational system for implementing functionality of a drying system, according to various embodiments.

FIG. 4 shows an illustrative computational system 400 for implementing functionality of a drying system, according to various embodiments. The computational system 400 can include or perform functionality of components of drying system 105 embodiments, such as those described above in FIGS. 1 and 3. For the sake of simplicity, the computational system 400 is shown including hardware elements that can be electrically coupled via a bus 455. However, embodiments of the computational system 400 can be implemented as or embodied in single or distributed computer systems, in one or more locations, or in any other useful way.

The hardware elements can include one or more central processing units (CPUs) 405 (e.g., controller 180), one or more input devices 410 (e.g., a mouse, a keyboard, a display 330, a payment interface 335, etc.), and one or more output devices 415 (e.g., a display 330, a payment interface 335, a coupon or receipt printer, etc.). The computational system 400 can also include one or more storage devices 420. By way of example, storage device(s) 420 can be disk drives, optical storage devices, solid-state storage device such as a random access memory (RAM) and/or a read-only memory (ROM), which can be programmable, flash-updateable and/or the like.

The computational system 400 can additionally include a computer-readable storage media reader 425*a*, a communications system 430 (e.g., communications subsystem 190, including a modem, a network card (wireless or wired), an infra-red communication device, etc.), and working memory 440, which can include RAM and ROM devices as described above. In some embodiments, the computational system 400 can also include a processing acceleration unit 435, which can include a DSP, a special-purpose processor, and/or the like.

The computer-readable storage media reader 425*a* can further be connected to a computer-readable storage medium 425*b*, together (and, optionally, in combination with storage device(s) 420) comprehensively representing remote, local, fixed, and/or removable storage devices plus storage media for temporarily and/or more permanently containing computer-readable information. The communications system 430 can permit data to be exchanged with a network 460 and/or any other computer described above with respect to the computational system 400. For example, as described with reference to FIGS. 1 and 3, payment information, CRM data, remote diagnostics, and/or other information can be communicated to and from the computational system 400 via the communications system 430 to the network 160.

The computational system 400 can also include software elements, shown as being currently located within a working memory 440, including an operating system 445 and/or other code 450, such as an application program (which can be a client application, web browser, mid-tier application, relational database management system (RDBMS), etc.). In some embodiments, one or more functions of the subscriber optimizer 120 are implemented as application code 450 in working memory 440. For example, as illustrated, pressurizing functionality 130, heating functionality 140, user interaction functionality 150, payment processing functionality 155, monitoring functionality 160, disinfecting functionality 170, etc. can be implemented as code of the working memory 440 (e.g., as part of the other code 450). Some embodiments further include a mechanical control system 470 to control various mechanical (e.g., electromechanical) features of the computational system 400. For example, the mechanical control system 470 can fully or partially control operation of the conveyor assembly 125, the door 315 to the drying chamber 110, motion of the drying chamber 110, etc.

Figure 5:
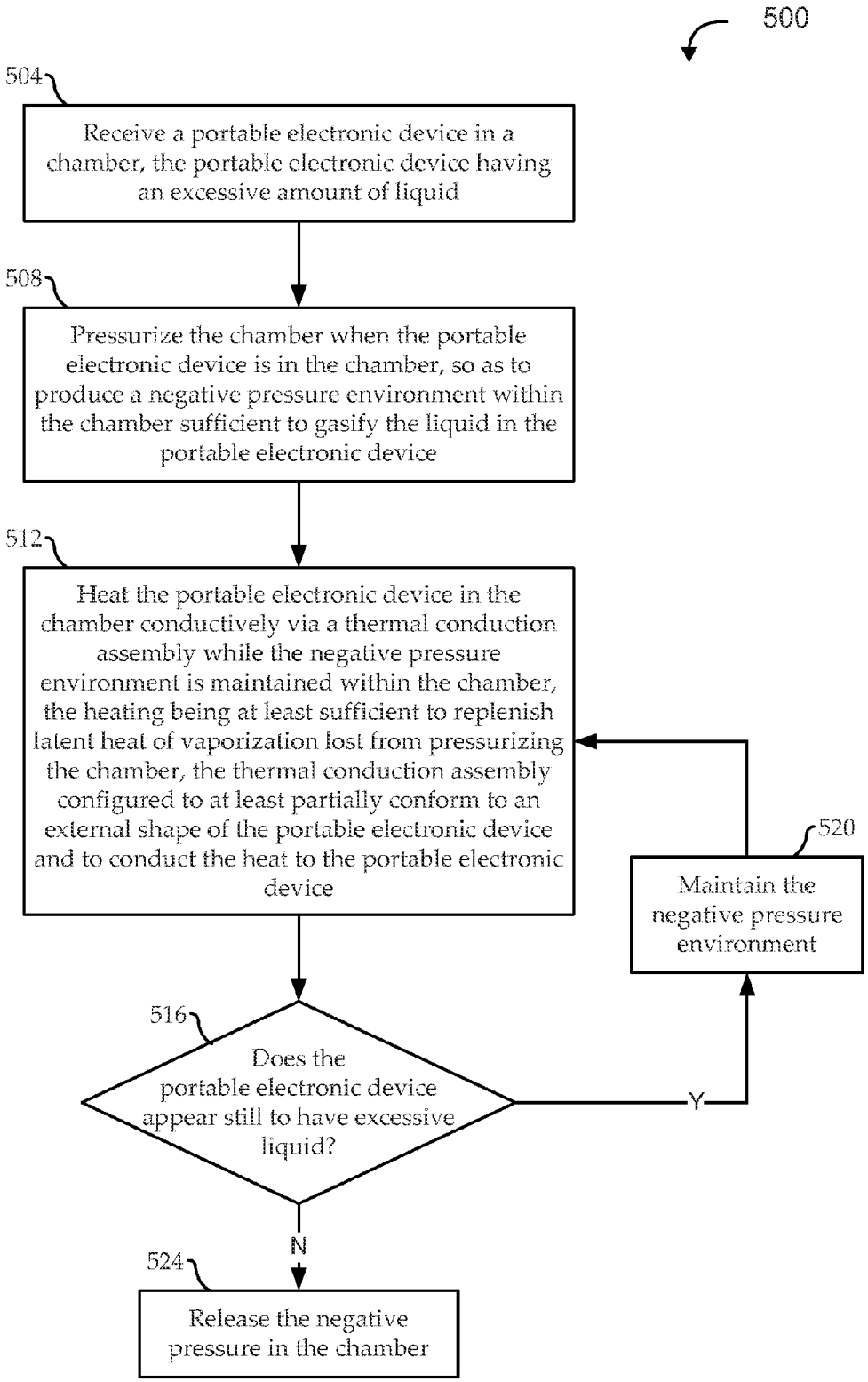
FIG. 5 shows a flow diagram of an illustrative method for drying a portable electronic device, according to various embodiments.

FIG. 5 shows a flow diagram of an illustrative method 500 for drying a portable electronic device, according to various embodiments. The method 500 operates in context of drying systems, such as those described above with reference to FIGS. 1-4. Embodiments begin at stage 504, by receiving a portable electronic device in a chamber. As described above, it is assumed that the portable electronic device has an excessive amount of liquid in (and possibly on) the device. The device can be placed in the chamber on a conveyor (e.g., a stationary or movable support structure) through a door or other sealable opening in the chamber. Typically, the device is placed into contact with a thermal conduction assembly or the device and/or the thermal conduction assembly are moved into contact with each other as the method 500 begins (e.g., when the chamber door is closed, etc.).

At stage 508, the chamber is pressurized when the portable electronic device is in the chamber, so as to produce a negative pressure environment (e.g., a substantial vacuum) within the chamber sufficient to gasify the liquid in the portable electronic device. For example, the chamber is fluidly coupled with a vacuum pump. When the vacuum is established and the liquid gasifies, latent heat of vaporization is lost. At stage 512, the portable electronic device is conductively heated in the chamber via a thermal conduction assembly (e.g., beads) while the negative pressure environment is maintained within the chamber. The heating is at least sufficient to replenish the latent heat of vaporization lost from pressurizing the chamber. As described above, any suitable type of thermal conduction assembly can be used that can at least partially conform to an external shape of the portable electronic device and can conduct the heat to the portable electronic device. At stage 516, a determination is made as to whether the excess liquid has been removed from the portable electronic device. If not, at stage 520, the negative pressure environment is maintained within the chamber. If so, at stage 524, the negative pressure in the chamber can be released (e.g., via a release valve).

Figure 6:
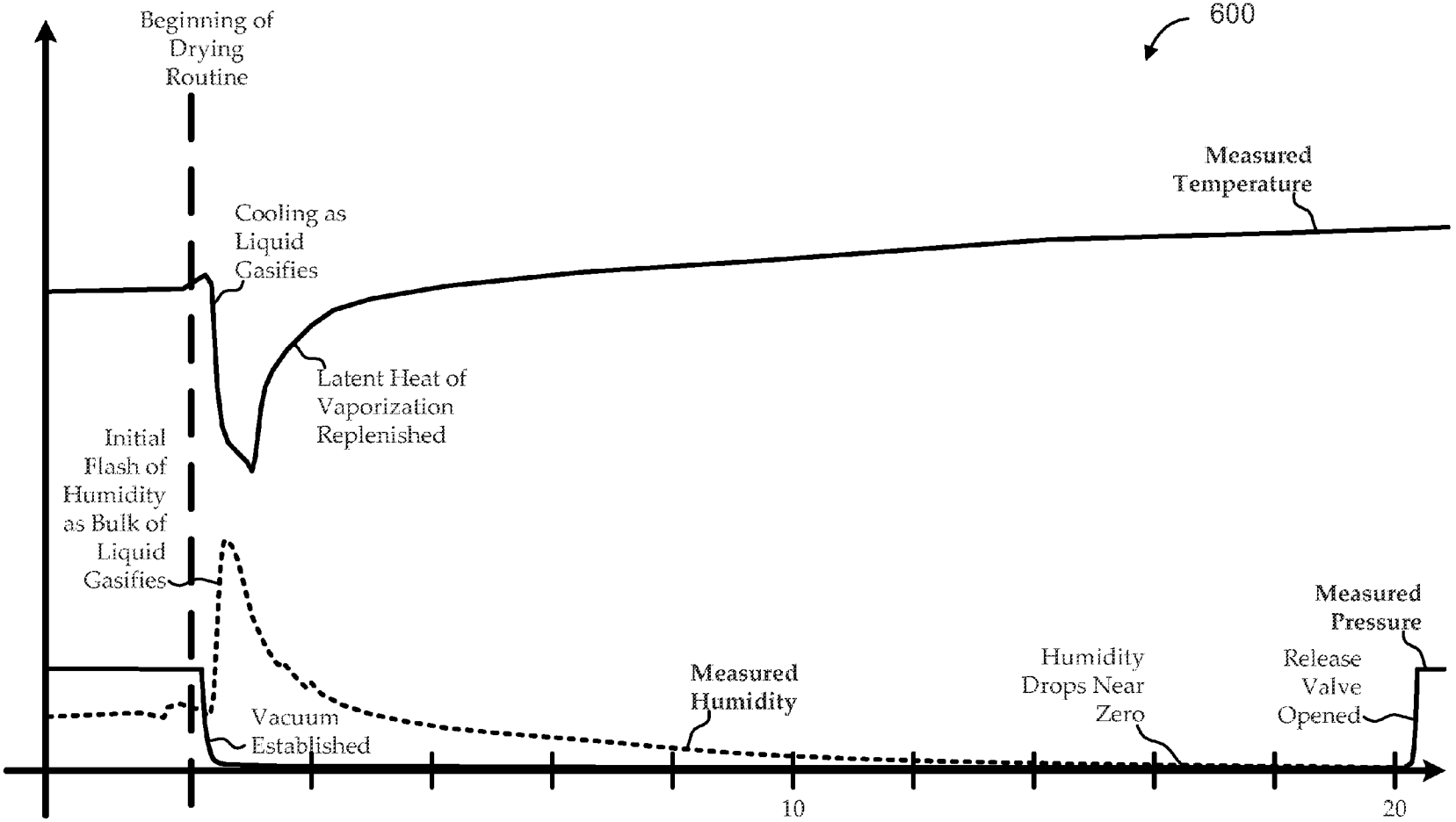
FIG. 6 shows a graphical representation of an illustrative drying cycle.

For the sake of illustration, FIG. 6 shows a graphical representation 600 of an illustrative drying cycle. Three traces are shown, representing temperature, pressure, and humidity levels measured within the drying chamber (e.g., adjacent to the portable electronic device) over time. For example, the cycle time is shown as approximately twenty minutes. A vertical dashed line indicates the beginning of the drying routine. As illustrated by the "measured pressure" trace, the system pressure begins at a "normal" atmospheric level, and quickly drops when the routine begins and a vacuum is established (producing a negative pressure environment) in the drying chamber. The desired vacuum level is substantially maintained until a release valve is opened at the end of the routine and pressure in the chamber returns to the normal atmospheric level. As illustrated by the "measured humidity" trace, the humidity in the drying chamber increases dramatically as the vacuum is first established and the bulk of the liquid in the portable electronic device gasifies (e.g., boils off). After that initial spike, the measured humidity in the chamber begins to drop, and continues to drop until it approaches zero by the end of the routine. As illustrated by the "measured temperature" trace, the temperature in the drying chamber decreases as the vacuum is first established, and the latent heat of vaporization is lost from gasification of the liquid. After the initial decrease in temperature, conductive heat applied to the portable electronic device gently replenishes the lost heat throughout the remainder of the routine, at least as desired.

The methods disclosed herein include one or more actions for achieving the described method. The method and/or actions can be interchanged with one another without departing from the scope of the claims. In other words, unless a specific order of actions is specified, the order and/or use of specific actions can be modified without departing from the scope of the claims.

The various operations of methods and functions of certain system components described above can be performed by any suitable means capable of performing the corresponding functions. These means can be implemented, in whole or in part, in hardware. Thus, they can include one or more Application Specific Integrated Circuits (ASICs) adapted to perform a subset of the applicable functions in hardware. Alternatively, the functions can be performed by one or more other processing units (or cores), on one or more integrated circuits (ICs). In other embodiments, other types of integrated circuits can be used (e.g., Structured/Platform ASICs, Field Programmable Gate Arrays (FPGAs), and other Semi-Custom ICs), which can be programmed. Each can also be implemented, in whole or in part, with instructions embodied in a computer-readable medium, formatted to be executed by one or more general or application-specific controllers. Embodiments can also be configured to support plug-and-play functionality (e.g., through the Digital Living Network Alliance (DLNA) standard), wireless networking (e.g., through the 802.11 standard), etc.

The steps of a method or algorithm or other functionality described in connection with the present disclosure, can be embodied directly in hardware, in a software module executed by a processor, or in a combination of the two. A software module can reside in any form of tangible storage medium. Some examples of storage media that can be used include random access memory (RAM), read only memory (ROM), flash memory, EPROM memory, EEPROM memory, registers, a hard disk, a removable disk, a CD-ROM and so forth. A storage medium can be coupled to a processor such that the processor can read information from, and write information to, the storage medium. In the alternative, the storage medium can be integral to the processor.

A software module can be a single instruction, or many instructions, and can be distributed over several different code segments, among different programs, and across multiple storage media. Thus, a computer program product can perform operations presented herein. For example, such a computer program product can be a computer-readable, tangible medium having instructions tangibly stored (and/or encoded) thereon, the instructions being executable by one or more processors to perform the operations described herein. The computer program product can include packaging material. Software or instructions can also be transmitted over a transmission medium. For example, software can be transmitted from a website, server, or other remote source using a transmission medium such as a coaxial cable, fiber optic cable, twisted pair, digital subscriber line (DSL), or wireless technology such as infrared, radio, or microwave.

Other examples and implementations are within the scope and spirit of the disclosure and appended claims. For example, features implementing functions can also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

Various changes, substitutions, and alterations to the techniques described herein can be made without departing from the technology of the teachings as defined by the appended claims. Moreover, the scope of the disclosure and claims is not limited to the particular aspects of the process, machine, manufacture, composition of matter, means, methods, and actions described above. Processes, machines, manufacture, compositions of matter, means, methods, or actions, presently existing or later to be developed, that perform substantially the same function or achieve substantially the same result as the corresponding aspects described herein can be utilized. Accordingly, the appended claims include within their scope such processes, machines, manufacture, compositions of matter, means, methods, or actions.

What is claimed is:

1. A drying system for portable electronic devices, the system comprising:

a pressurization subsystem configured, when the portable electronic device is in a chamber, to produce a negative pressure environment throughout the chamber sufficient to gasify liquid in the portable electronic device; and a thermal conduction assembly configured, when the portable electronic device is in the negative pressure environment throughout the chamber, to substantially conform in three dimensions to an external shape of the portable electronic device and to conduct heat to the portable electronic device sufficient to at least overcome latent heat of evaporation resulting from the gasifying of the liquid in the portable electronic device.

2. The system of claim 1, further comprising the chamber.

3. The system of claim 2, wherein:

the chamber is configured to concurrently receive a plurality of portable electronic devices; and the thermal conduction assembly is configured, when the plurality of portable electronic devices is in the chamber, to substantially conform and to conduct heat concurrently to each portable electronic device.

4. The system of claim 2, wherein:

the chamber is one of a plurality of chambers, each configured receive at least one portable electronic device;

the pressurization subsystem is coupled with the plurality of chambers and is configured to produce the negative pressure environment throughout each chamber; and the thermal conduction assembly is one of a plurality of thermal conduction assemblies, each disposed in relation to an associated one of the plurality of chambers.

5. The system of claim 4, wherein:

the pressurization subsystem is coupled with each of the plurality of chambers and is configured to selectively and independently produce the negative pressure environment throughout each chamber.

6. The system of claim 1, wherein the thermal conduction assembly is configured to dynamically conform in three dimensions around at least some of the external shape of the portable electronic device in response to receiving the portable electronic device.

7. The system of claim 1, wherein the thermal conduction assembly is shaped to statically conform in three dimensions around at least some of the external shape of the portable electronic device.

8. The system of claim 1, wherein the thermal conduction assembly is configured to conform to a majority of the external shape of the portable electronic device.

9. The system of claim 1, wherein the thermal conduction assembly is configured so that, when the portable electronic device is within the chamber, the portable electronic device is at least partially immersed in the thermal conduction assembly.

10. The system of claim 1, wherein the thermal conduction assembly comprises a plurality of thermally conductive beads.

11. The system of claim 10, wherein the thermally conductive beads manifest a thermal conductivity of at least 0.5 W/m° K.

12. The system of claim 10, wherein the thermally conductive beads are metallic.

13. The system of claim 10, wherein the plurality of thermally conductive beads is a first plurality of beads that manifest a first thermal conductivity, and the thermal conduction assembly further comprises a second plurality of beads that is interspersed with the first plurality of beads and manifests a second thermal conductivity that is lower than the first thermal conductivity.

14. The system of claim 13, further comprising:

a disinfecting subsystem configured to irradiate the portable electronic device with radiation while the portable electronic device is in the chamber, wherein the thermal conduction assembly is configured to permit transmission of the radiation to the portable electronic device via the plurality of substantially non-conductive beads.

15. The system of claim 10, wherein the thermal conduction assembly further comprises at least one receptacle for the thermally conductive beads, the receptacle being configured to at least partially conform to the external shape of the portable electronic device and to conduct the heat to the portable electronic device via the beads.

16. The system of claim 10, wherein the thermal conduction assembly further comprises structure from which the thermally conductive beads hang in such a way that permits the beads to substantially conform to the external shape of the portable electronic device and to conduct the heat to the portable electronic device.

17. The system of claim 1, wherein the thermal conduction assembly comprises structure to support a plurality of thermally conductive pins in such a way that permits the pins to substantially conform to the external shape of the portable electronic device and to conduct the heat to the portable electronic device.

18. The system of claim 1, wherein the thermal conduction assembly comprises at least one receptacle shaped to thermally couple in a non-planar manner with at least a portion of the external shape of the portable electronic device and to conduct the heat to the portable electronic device.

19. The system of claim 1, further comprising:

a heating subsystem configured to generate the heat and comprising the thermal conduction assembly.

20. The system of claim 1, further comprising:

a monitoring subsystem comprising at least one sensor within the chamber configured to monitor at least one of internal pressure of the chamber, internal temperature of the chamber, internal humidity of the chamber, or functionality of the portable electronic device.

21. The system of claim 20, wherein the monitoring subsystem comprises:

an interface cable configured to communicate with the portable electronic device to determine the functionality of the portable electronic device.

22. The system of claim 20, further comprising:

a heating subsystem configured to apply heat to the thermal conduction assembly, wherein the monitoring subsystem is configured to determine whether sufficient heat is being delivered to the portable electronic device to at least overcome the latent heat of evaporation resulting from the gasifying of the liquid in the portable electronic device, and the heating subsystem is in communication with the monitoring subsystem and is configured to automatically regulate the heat in accordance with the determining.

23. A method for drying portable electronic devices, the method comprising:

receiving a portable electronic device in a chamber in such a manner that causes a thermal conduction assembly to substantially conform in three dimensions around the portable electronic device, the portable electronic device having an excessive amount of liquid;

pressurizing the chamber when the portable electronic device is in the chamber, so as to produce a negative pressure environment throughout the chamber sufficient to gasify the liquid in the portable electronic device at least until the portable electronic device no longer has the excessive amount of liquid; and heating the portable electronic device in the chamber conductively via the thermal conduction assembly during the pressurizing, the heating being at least sufficient to replenish latent heat of vaporization lost from the gasifying of the liquid.

24. The method of claim 23, wherein:

the receiving comprises receiving a portable electronic device in each of a plurality of chambers concurrently, in such a manner that causes a respective thermal conduction assembly in each chamber to substantially conform in three dimensions around its respective portable electronic device; and the pressurizing comprises pressurizing each chamber to produce a respective negative pressure environment throughout each chamber sufficient to gasify the liquid in its respective portable electronic device.

25. The method of claim 23, wherein the thermal conduction assembly is configured to dynamically conform in three dimensions around at least a portion of the external shape of the portable electronic device.

26. The method of claim 23, wherein the thermal conduction assembly is shaped to statically conform in three dimensions around at least a portion of the external shape of the portable electronic device.

27. The method of claim 23, wherein the receiving comprises at least partially immersing the portable electronic device in the thermal conduction assembly.

28. The method of claim 23, wherein the receiving comprises sandwiching the portable electronic device between a plurality of heating components of the thermal conduction assembly.

29. The method of claim 23, wherein the receiving comprises receiving the portable electronic device in at least one receptacle shaped to thermally couple in a non-planar manner with at least a portion of the external shape of the portable electronic device and to conduct the heat to the portable electronic device.

30. The method of claim 23, further comprising:

irradiating the portable electronic device with radiation while the portable electronic device is in the chamber, wherein the thermal conduction assembly is configured to permit transmission of the radiation to the portable electronic device.

31. The method of claim 23, further comprising:

monitoring at least one of internal pressure of the chamber, internal temperature of the chamber, internal humidity of the chamber, or functionality of the portable electronic device; and dynamically adjusting at least one of the pressurizing or the heating in accordance with the monitoring.

32. The method of claim 23, further comprising:

the heating comprises heating the thermal conduction assembly to a desired level and subsequently ceasing to heat the thermal conduction assembly prior to the receiving, the thermal conduction assembly configured to store heat to a sufficient extent to replenish latent heat of vaporization lost from the gasifying of the liquid during the pressurizing.

* * * * *